US007404416B2

(12) United States Patent
Schultz et al.

(10) Patent No.: US 7,404,416 B2
(45) Date of Patent: Jul. 29, 2008

(54) APPARATUS AND METHOD FOR CREATING PULSATING FLUID FLOW, AND METHOD OF MANUFACTURE FOR THE APPARATUS

(75) Inventors: Roger L. Schultz, Aubrey, TX (US); Robert K. Michael, Frisco, TX (US); Pete C. Dagenais, The Colony, TX (US); Michael L. Fripp, Carrollton, TX (US); James C. Tucker, Springer, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 673 days.

(21) Appl. No.: 10/808,986

(22) Filed: Mar. 25, 2004

(65) Prior Publication Data

US 2005/0214147 A1 Sep. 29, 2005

(51) Int. Cl.
*E21B 37/00* (2006.01)

(52) U.S. Cl. ..... 137/835; 175/67; 239/589.1

(58) Field of Classification Search ..... 137/835, 137/841, 812–813, 834; 239/589–589.1; 166/222; 175/67
See application file for complete search history.

(56) References Cited

U.S. PATENT DOCUMENTS

| | | | | |
|---|---|---|---|---|
| 3,158,166 | A | 11/1964 | Warren | 137/81.5 |
| 3,181,546 | A | 5/1965 | Boothe | 137/81.5 |
| 3,181,596 | A | 5/1965 | Winnan et al. | 160/206 |
| 3,247,861 | A | 4/1966 | Bauer | 137/81.5 |
| 3,405,770 | A | 10/1968 | Galle et al. | 175/56 |
| 3,423,026 | A | 1/1969 | Carpenter | 239/284 |
| 3,432,102 | A | 3/1969 | Turner et al. | 239/242 |
| 3,448,752 | A * | 6/1969 | O'Neill | 137/826 |
| 3,563,462 | A | 2/1971 | Bauer | 239/102 |
| 3,614,964 | A * | 10/1971 | Chen | 137/815 |

(Continued)

FOREIGN PATENT DOCUMENTS

JP 62 251 508 A 11/1987

OTHER PUBLICATIONS

Foreign Communication from a related counterpart application dated May 2, 2005, International application No. PCT/GB2005/000092.

(Continued)

*Primary Examiner*—John Rivell
*Assistant Examiner*—Craig M Schneider
(74) *Attorney, Agent, or Firm*—John W. Wustenberg; Baker Botts, L.L.P.

(57) ABSTRACT

In one embodiment, the present invention provides an apparatus for creating pulsating fluid flow, including an inlet into which fluid flows and a chamber having an upstream end and a downstream end. The chamber is defined by a pair of outwardly-projecting sidewalls, and the inlet is disposed at the upstream end of the chamber. This particular embodiment further includes at least two feedback passages with opposed entrances at the downstream end of the chamber and opposed exits at the upstream end of the chamber, near where the chamber joins the inlet. At least one feedback outlet leaves each of the feedback passages. A feedback cavity is disposed at the downstream end of the chamber. At least one exit flowline having an exit port leaves the at least one feedback outlet.

54 Claims, 6 Drawing Sheets

U.S. PATENT DOCUMENTS

| | | | | |
|---|---|---|---|---|
| 3,741,481 | A | 6/1973 | Bauer | 239/102 |
| 3,842,907 | A | 10/1974 | Baker et al. | |
| 3,998,386 | A | 12/1976 | Viets et al. | 239/102 |
| 4,006,755 | A | 2/1977 | Kranz et al. | 137/831 |
| 4,007,625 | A | 2/1977 | Houben et al. | 73/23 |
| 4,052,002 | A | 10/1977 | Stouffer et al. | 239/4 |
| 4,157,161 | A | 6/1979 | Bauer | 239/11 |
| 4,184,636 | A | 1/1980 | Bauer | 239/11 |
| 4,244,230 | A | 1/1981 | Bauer | 73/861.19 |
| 4,463,904 | A | 8/1984 | Bray, Jr. | 239/284 R |
| 4,630,689 | A | 12/1986 | Galle et al. | 175/56 |
| 4,775,016 | A | 10/1988 | Barnard | 175/56 |
| RE33,448 | E * | 11/1990 | Bauer | 239/11 |
| 5,135,051 | A | 8/1992 | Facteau et al. | 166/104 |
| 5,165,438 | A | 11/1992 | Facteau et al. | 137/1 |
| 5,195,560 | A | 3/1993 | Achmad | 137/826 |
| 5,228,508 | A | 7/1993 | Facteau et al. | 166/177 |
| 5,396,808 | A | 3/1995 | Huang et al. | 73/861.19 |
| 5,396,809 | A | 3/1995 | Huang | 73/861.19 |
| 5,505,262 | A | 4/1996 | Cobb | 166/312 |
| 5,893,383 | A | 4/1999 | Facteau | 137/14 |
| RE38,013 | E | 3/2003 | Stouffer | 239/284.1 |
| 6,572,570 | B1 | 6/2003 | Burns et al. | 601/148 |
| 6,606,915 | B2 | 8/2003 | Vannuffelen | 73/861.22 |
| 6,976,507 | B1 * | 12/2005 | Webb et al. | 137/826 |

OTHER PUBLICATIONS

*SPE Paper* 13803, R.A. Payne, et al., Pressure Fluctuating Tool, pp. 105-110, 1985.

Paper entitled Experimental and Computational Visualization and Frequency Measurements of the Jet Oscillation Inside a Fluidic Oscillator, O. Uzol, C. Camci, 4th International Symposium on Particle Image Velocimetry, dated 2001.

* cited by examiner (PRIOR. ART)

APPARATUS AND METHOD FOR CREATING PULSATING FLUID FLOW, AND METHOD OF MANUFACTURE FOR THE APPARATUS

FIELD OF THE INVENTION

The present invention relates to improved apparatuses and improved methods for creating pulsating fluid flow and methods for manufacture of those apparatuses; more specifically, the present invention relates to improved apparatuses and improved methods for expelling pulses of fluid sequentially from different ports in a repeated cycle and methods for manufacture of those apparatuses.

BACKGROUND OF THE INVENTION

The prior art includes a number of devices that rely on fluid oscillation effects to create pulsating fluid flow. Generally, these devices connect to a source of fluid flow, provide a mechanism for oscillating the fluid flow between two different locations within the device and emit fluid pulses downstream of the source of fluid flow. These devices require no moving parts to generate the oscillations and have been used in various applications for which pulsating fluid flow is desired, such as massaging showerheads, flowmeters, and windshield-wiper-fluid-supply units.

A typical prior art apparatus for creating pulsating fluid flow includes body 10 with a nozzle 20 that attaches to a fluid source 30, as shown in FIG. 1. The nozzle 20 expels the fluid as a jet into a chamber 40 toward a flow splitter 50. This flow splitter 50 traditionally assumes a triangular or trapezoidal shape, with a narrow leading edge directly in the path of the jet. The sides of flow splitter 50 form the inner walls of two fluid pathways 60 and 60' that initially diverge and then become parallel as they leave apparatus. The body 10 forms the outer walls of the two fluid pathways 60 and 60', as well as at least two feedback passages 70 and 70' leading from the fluid pathways back into the chamber. Each feedback passage 70 or 70' will be disposed along one of the fluid pathways, 60 or 60', respectively.

The jet will cling to one side of chamber 40 due to a phenomenon called the Coanda effect, explained in more detail later in this disclosure. Thus, the fluid will flow through one of the two fluid pathways 60 or 60' at a time. Flow splitter 50 also helps guide the flow into either fluid pathway 60 or fluid pathway 60'. As the fluid flows through one fluid pathway such as fluid pathway 60, feedback passage 70 will divert a portion of the fluid and return it to chamber 40. The fluid will then disturb the fluid flow along the side of chamber 40 closest to fluid pathway 60. This disturbance will cause the fluid flow to switch to the side of the chamber closest to fluid pathway 60'. Fluid will thus leave from fluid pathway 60', rather than from fluid pathway 60. As a result, the apparatus for creating pulsating fluid flow will emit pulses of fluid in succession from the two fluid pathways 60 and 60', with only one fluid pathway 60 or 60' ejecting fluid at a given time.

Generally, prior art apparatuses for creating pulsating fluid flow are manufactured from two rectangular blocks of a material suitable for the particular application. For example, if the apparatus for creating pulsating fluid flow will be used in a well bore, stainless steel blocks may be appropriate. A path for fluid flow is machined into the largest flat surface of one of the rectangular blocks. The two blocks are then joined together and the entire apparatus is lathed into a generally cylindrical form. This method of manufacture is labor-intensive and time-consuming.

Some applications for apparatuses for creating pulsating fluid flow require sharper fluid pulses than others. For example, apparatuses for creating pulsating fluid flow may be used to clean fluid flowlines or well bores. The apparatus for creating pulsating fluid flow is joined to a source of cleaning fluid and then is inserted into the flowline or well bore. Pulsating fluid flow has been found to be superior to steady fluid flow for cleaning surfaces such as the interior of a fluid flowline or well bore. Moreover, sharp fluid pulses dislodge buildup and debris from these surfaces better than less-defined fluid pulses because sharply defined pressure pulses have a higher frequency content. Prior art apparatuses, however, may not provide the pulse definition cleaning applications require. In addition, because prior art apparatuses emit fluid parallel to the nozzle, they do not always effectively clean areas located alongside the apparatus. For example, a prior art apparatus used downhole will not remove matter caked on the well bore because it will eject fluid down the center of the well bore, not at the sides.

Prior art apparatuses for creating pulsating fluid flow often exhibit erratic, weak or even no oscillation when used in submerged environments such as fluid flowlines or well bores. Prior art apparatuses generally rely on atmospheric air to boost the fluid oscillations. These apparatuses accordingly allow air to enter the path of the fluid. These apparatuses fail to provide reliable, robust fluid pulses in environments where air is unavailable, such as in fluid flowlines or well bores.

SUMMARY OF THE INVENTION

The present invention relates to improved apparatuses and improved methods for creating pulsating fluid flow and methods for manufacture of those apparatuses; more specifically, the present invention relates to improved apparatuses and improved methods for expelling pulses of fluid sequentially from different ports in a repeated cycle and methods for manufacture of those apparatuses.

In one embodiment, the present invention provides an apparatus for creating pulsating fluid flow, including an inlet into which fluid flows and a chamber having an upstream end and a downstream end. The chamber is defined by a pair of outwardly-projecting sidewalls, and the inlet is disposed at the upstream end of the chamber. This particular embodiment further includes at least two feedback passages with opposed entrances at the downstream end of the chamber and opposed exits at the upstream end of the chamber, near where the chamber joins the inlet. At least one feedback outlet leaves each of the feedback passages. A feedback cavity is disposed at the downstream end of the chamber. At least one exit flowline having an exit port leaves the at least one feedback outlet.

In one embodiment, the present invention provides an apparatus for creating a pulsating fluid flow, including an inlet into which fluid flows and a chamber with an upstream end and a downstream end. The chamber is defined by a pair of outwardly-projecting sidewalls, and the inlet is disposed at the upstream end of the chamber. The apparatus includes at least two feedback passages with opposed entrances at the downstream end of the chamber and opposed exits at the upstream end of the chamber, near where the chamber joins the inlet. A feedback cavity is disposed at the downstream end of the chamber, and at least one exit flowline having an exit port leaves each of the feedback passages.

In one embodiment, the present invention provides an apparatus for creating pulsating fluid flow, including an inlet into which fluid flows disposed between opposed cusps. The apparatus further includes an oscillation cavity defined by a concave rear wall and two opposed exit flowlines leaving the oscillation cavity near the inlet and opposed cusps. Each of the two opposed exit flowlines has an exit port, and the two opposed exit flowlines curve such that a portion of each of the two opposed exit flowlines is substantially perpendicular to the inlet.

In one embodiment, the present invention provides an apparatus for creating pulsating fluid flow, including an inlet into which fluid flows and a chamber having an upstream end and a downstream end. The chamber is defined by a pair of outwardly-projecting sidewalls, and the inlet is disposed at the upstream end of the chamber. The apparatus further includes at least two feedback passages with opposed entrances at the downstream end of the chamber and opposed exits at the upstream end of the chamber near where the chamber joins the inlet. Two exit flowlines leave the downstream end of the chamber. The two exit flowlines outwardly diverge from the flow of fluid into the inlet.

In one embodiment, the present invention provides a method of creating a pulsating fluid flow, including injecting a fluid through an inlet from a fluid flowline and directing the fluid into a chamber. The method further includes directing a portion of the fluid through at least two feedback passages that leave the chamber and return the chamber, forcing the fluid to oscillate inside the chamber. The method also includes directing the remaining fluid into a feedback cavity and redirecting the remaining fluid from the feedback cavity to the chamber to strengthen the fluid's oscillation. The method includes directing the fluid through at least one feedback outlet leaving each of the feedback passages and discharging the fluid through at least one exit flowline leaving the at least one feedback outlet to form a pulsating jet.

In one embodiment, the present invention provides a method of creating a pulsating fluid flow, including injecting a fluid through an inlet from a fluid flowline and directing the fluid into a chamber having an upstream end and a downstream end. The chamber is defined by a pair of outwardly-projecting sidewalls, and the inlet is disposed at the upstream end of the chamber. The method further includes directing a portion of the fluid through at least two feedback passages. The two feedback passages have opposed entrances at the downstream end of the chamber and opposed exits at the upstream end of the chamber near where the chamber joins the inlet. The method also includes directing the remaining fluid into a feedback cavity disposed at the downstream end of the chamber and redirecting the remaining fluid from the feedback cavity disposed at the downstream end of the chamber back to the chamber to strengthen the fluid's oscillation. The method includes directing the fluid through at least one feedback outlet leaving each of the feedback passages and discharging the fluid through at least one exit flowline that has an exit port and leaves the at least one feedback outlet, to form a pulsating jet at the exit port.

In one embodiment, the present invention provides a method for manufacture of an apparatus for creating pulsating fluid flow, including forming a flowpath for creating pulsating fluid flow on a mandrel to create a fluidic oscillator insert, forming a housing for the fluidic oscillator insert, and inserting the fluidic oscillator insert into the housing to form the apparatus for creating pulsating fluid flow.

The features and advantages of the present invention will be readily apparent to those skilled in the art upon a reading of the description of the embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 8:
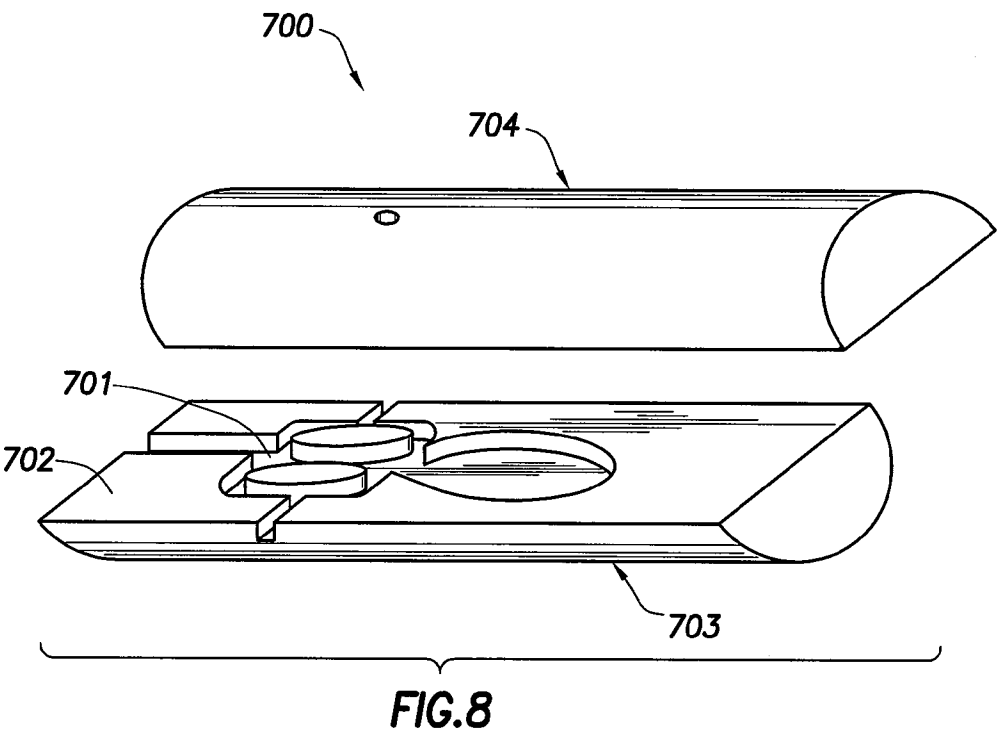
FIG. 8 illustrates a view of components of an exemplary embodiment of an apparatus of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION

Figure 2:
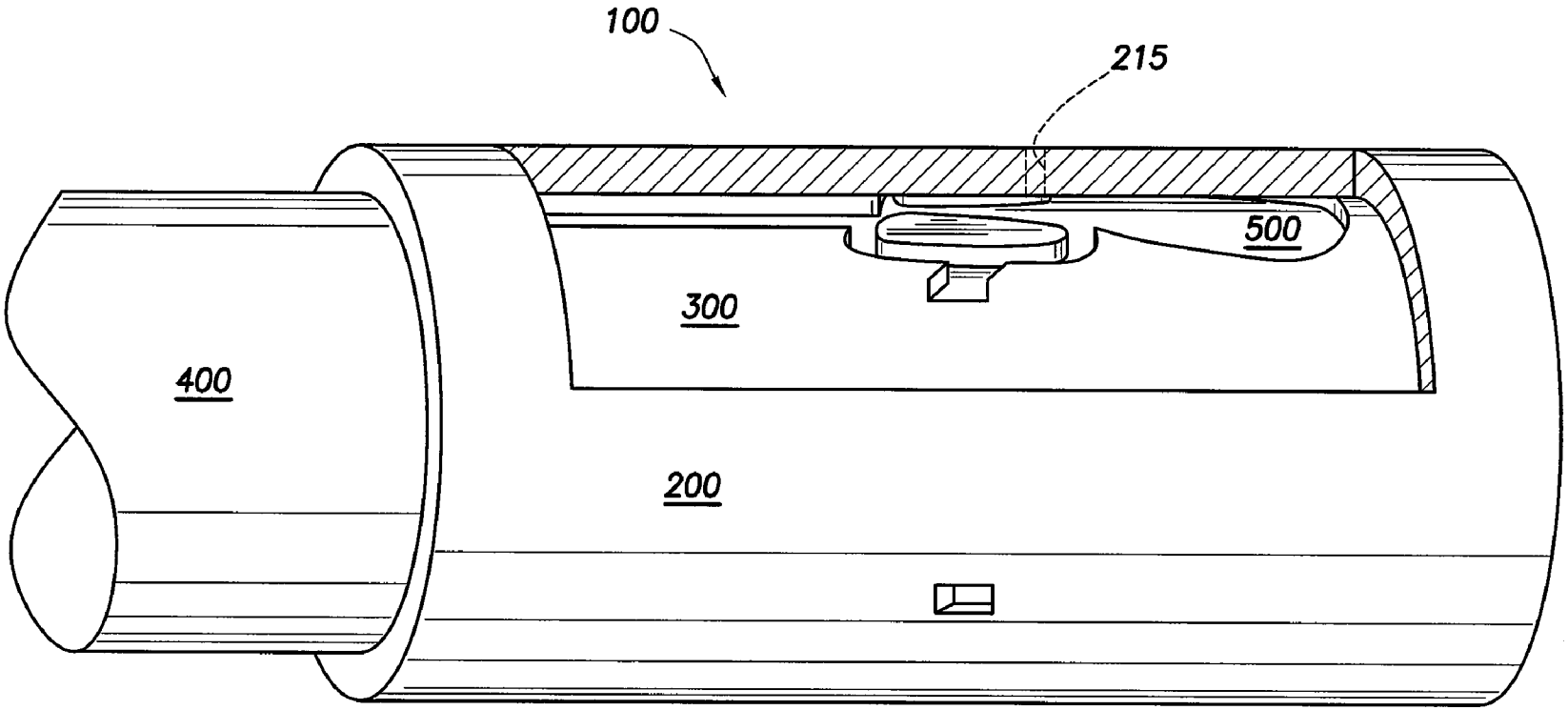
FIG. 2 illustrates a longitudinal view of an exemplary embodiment of an apparatus of the present invention, with portions of the outer surface of the apparatus removed to display the interior of the apparatus.

The present invention relates to improved apparatuses and improved methods for creating pulsating fluid flow and methods for manufacture of those apparatuses; more specifically, the present invention relates to improved apparatuses and improved methods for expelling pulses of fluid sequentially from different ports in a repeated cycle and methods for manufacture of those apparatuses. FIG. 2 illustrates an exemplary embodiment of an apparatus for creating pulsating fluid flow 100. The apparatus for creating pulsating fluid flow 100 comprises housing 200 and fluidic oscillator insert 300. FIG. 2 displays a partially cutaway view of housing 200 to better display fluidic oscillator insert 300. In certain exemplary embodiments, housing 200 and fluidic oscillator insert 300 are cylindrical in form, although they may alternatively have rectangular or other-shaped cross-sections. Fluid flowline 400 supplies fluid to fluidic oscillator insert 300. Fluid flowline 400 may connect to fluidic oscillator insert 300 through housing 200 by a variety of means. The most appropriate connecting means will vary with the application for which the apparatus for creating pulsating fluid flow 100 will be used and will be readily apparent to a person ordinarily skilled in the art having the benefit of this disclosure.

Figure 3:
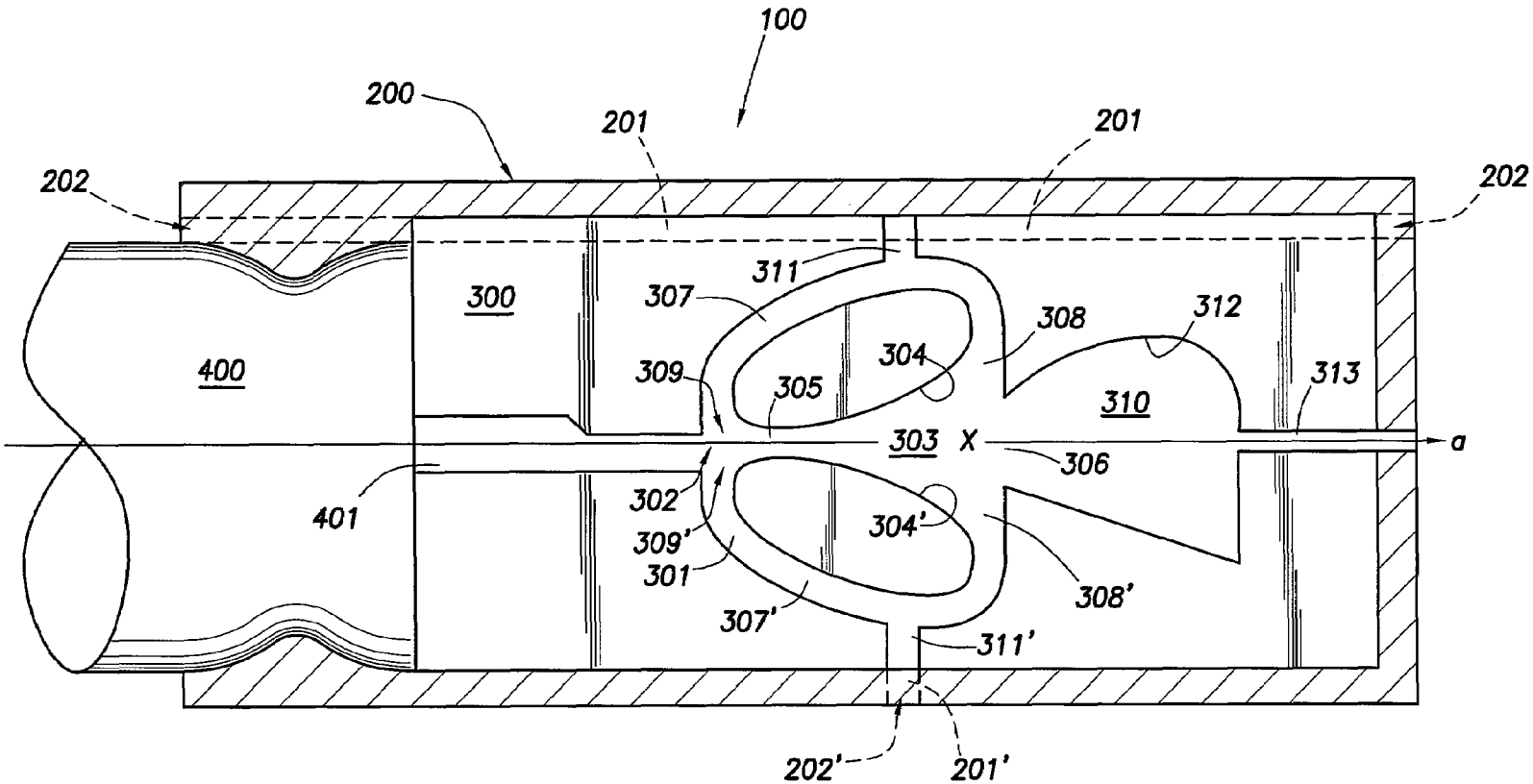
FIG. 3 illustrates a top view of exemplary embodiments of the apparatus of the present invention.

FIG. 3 depicts a top view of an exemplary embodiment of fluidic oscillator insert 300. The top half of FIG. 3 differs from the bottom half to show different embodiments of the present invention. However, in certain embodiments, fluidic oscillator insert 300 is symmetrical about longitudinal axis "a," rather than asymmetrical as shown in FIG. 3. Fluidic oscillator insert 300 directs fluid through a flowpath, denoted generally by numeral 301, that creates pulsating fluid flow. FIG. 3 depicts flowpath 301 in two dimensions for simplicity. Flowpath 301, however, is formed of recesses in fluidic oscillator insert 300. These recesses are denoted generally by the numeral 500 in FIG. 2. Flowpath 301 therefore has a depth that descends into the plane of the page in FIG. 3. In certain exemplary embodiments, the recesses that form flowpath 301 have a rectangular cross-section. A suitable cross-section for flowpath 301 depends on the application for which the apparatus for creating pulsating fluid flow 100 will be used and will be readily apparent to a person of ordinarily skill in the art having the benefit of this disclosure. Housing 200 fits closely over fluidic oscillator insert 300 so as to confine the fluid to recesses 500, as shown in FIG. 2.

In certain exemplary embodiments, after the fluid enters fluidic oscillator insert 300 through fluid flowline 400, fluidic oscillator insert 300 directs the fluid into interior flowline 401 and then into inlet 302, as shown in FIG. 3. In an exemplary embodiment, interior flowline 401 may decrease in width as it approaches inlet 302, as shown in the top half of FIG. 3. The fluid exits inlet 302 as a jet and enters chamber 303. Chamber 303 is defined by two outwardly-projecting sidewalls 304 and 304' and has an upstream end 305 and a downstream end 306. A feedback cavity 310 is disposed at downstream end 306. Again, housing 200 covers the entire flowpath 301, such that the fluid cannot escape from the flowpath onto the top of fluidic oscillator insert 300.

The fluid forms a jet as it streams from inlet 302 into chamber 303 of the certain exemplary embodiment shown in FIG. 3. As the jet leaves fluid inlet 302, the fluid tends to cling to one of the two outwardly-projecting sidewalls 304 or 304'. This tendency is a result of a well-documented phenomenon known as the "Coanda effect." When the fluid exits inlet 302 as a jet into chamber 303, it draws any fluid between the jet and one of the two outwardly-projecting sidewalls 304 or 304' into the jet. For example, the jet may first draw fluid between the jet and outwardly-projecting sidewall 304 into the jet. The temporary absence of fluid between the jet and outwardly-projecting sidewall 304 creates a low-pressure region. Before the ambient pressure in chamber 303 can restore pressure to this region, the jet is drawn to outwardly-projecting sidewall 304 and clings to its surface. The result of this Coanda effect is that the fluid enters chamber 303 along one of the sidewalls 304 or 304', rather than in the center.

The pulsating action of the fluid flow generated by exemplary embodiments of the present invention arises from switches in the flow from along outwardly-projecting sidewall 304 to along outwardly-projecting sidewall 304', and vice versa. At least two feedback passages 307 and 307' are disposed on opposite sides of chamber 303 to help achieve these switches. Two opposed entrances 308 and 308' to the feedback passages 307 and 307' leave from the downstream end 306 of chamber 303. Two opposed exits 309 and 309' to the feedback passages 307 and 307' join the upstream end 305 of chamber 303. To continue with the example of the previous paragraph, a portion of the fluid will reach opposed entrance 308 and be directed into feedback passage 307 once it has traveled along sidewall 304. Of the portion of fluid that enters feedback passage 307, a smaller portion of the fluid will exit the fluidic oscillator insert 300 through feedback outlet 311, discussed later in more detail. The rest of the fluid that enters feedback passage 307, however, will be directed to opposed exit 309 and back into chamber 303. The entry of this fluid into chamber 303 disturbs the path of the jet of fluid issuing from inlet 302 such that the jet no longer adheres to outwardly-projecting sidewall 304. The jet of fluid will instead adhere to outwardly-projecting sidewall 304' in the same manner as it adhered to outwardly-projecting sidewall 304.

The jet of fluid will then travel along the surface of outwardly-projecting sidewall 304', and a portion of the fluid will enter opposed entrance 308'. This portion of the fluid will be directed into feedback passage 307'. Another portion of the fluid will be diverted from feedback passage 307' into feedback outlet 311', to be discussed later in more detail. The rest of the fluid entering feedback passage 307' will continue to opposed exit 309' and enter chamber 303. As with the fluid entering chamber 303 from opposed exit 309, the fluid leaving opposed exit to feedback passage 309' will disturb the flow of fluid along the surface of outwardly-projecting sidewall 304'. The fluid path will switch from traveling along outwardly-projecting sidewall 304' to traveling along outwardly-projecting sidewall 304, and the cycle will repeat.

At any time when the fluid flows along outwardly-projecting sidewall 304 and through feedback passage 307, no fluid flows along outwardly-projecting sidewall 304' and through feedback passage 307'. The converse is also true. This oscillation of fluid from one half of the fluidic oscillator insert 300 to the other helps create the desired pulsating fluid flow. In particular, as fluid travels through either feedback passage 307 or 307', a portion of the fluid will be drawn off by feedback outlet 311 or 311', respectively. Fluid entering feedback outlets 311 and 311' will be directed outside fluidic oscillator insert 300 into housing 200 and exit the apparatus through either exit flowline 201 or 201', respectively. The effect of the flow oscillation between outwardly-projecting sidewalls 304 and 304' and through feedback passages 307 and 307' is that fluid will exit from only one feedback outlet 311 or 311' at a given point in time. The fluid will travel from feedback outlets 311 or 311' through exit flowlines 201 or 201', respectively. Once the fluid has reached the end of exit flowlines 201 and 201', the fluidic oscillator insert 300 will emit pulses of fluid through exit ports 202 and 202' in succession.

Feedback cavity 310, disposed at the downstream end 306 of chamber 303, further promotes the oscillation of fluid flow in fluidic oscillator insert 300. While a portion of the fluid traveling along outwardly-projecting sidewalls 304 and 304' is directed into the opposed entrances to the feedback passages 308 and 308', the remainder of the fluid exits chamber 303 into feedback cavity 310. If the fluid enters feedback cavity 310 after traveling along outwardly-projecting sidewall 304, it follows a clockwise path around feedback cavity sidewall 312 and returns to chamber 303 near outwardly-projecting sidewall 304'. This fluid flow near outwardly-projecting sidewall 304' destabilizes the fluid flow along outwardly-projecting sidewall 304. This added instability amplifies the oscillation effect produced by feedback passages 308 by drawing fluid to outwardly-projecting sidewall 304' from outwardly-projecting sidewall 304. The cycle then reverses, with fluid entering from along outwardly-projecting sidewall 304' and following a counterclockwise path in feedback cavity 310 to near outwardly-projecting sidewall 304. In certain embodiments, as shown in the top half of FIG. 3, the feedback cavity has a rounded shape. However, any volume that extends beyond the opposed entrances to the feedback passages 308 and 308' may serve as a feedback cavity 310, regardless of the shape the volume assumes. For example, in another embodiment, feedback cavity 310 may assume a trapezoidal configuration, as seen in the bottom half of FIG. 3.

Feedback outlets 311 and 311' and exit flowlines 201 and 201' may take any number of different paths that meet the requirements of specific applications, including paths that diverge from the plane of flowpath 301 shown in FIG. 3, as indicated by the dashed lines for exit flowline 201. The best configuration for the feedback outlets and exit flowlines will depend on the specific application, as will be apparent to those of ordinary skill in the art having the benefit of this disclosure. In certain exemplary embodiments, feedback outlets 311 and 311' are substantially perpendicular to a tangent to the feedback passages 307 and 307', respectively, if the tangent is taken at the points where the feedback outlets 311 and 311' are located. This configuration allows fluid to leave the feedback passages 307 and 307' through feedback outlets 311 and 311' while leaving a sufficient amount of fluid in feedback passages 307 and 307' to drive the oscillation cycle.

In an exemplary embodiment, the exit flowlines may be entirely substantially perpendicular to the flow of fluid into the inlet, as illustrated by exit flowline 201' shown in the bottom half of FIG. 3. This configuration may best suit applications for which the fluid pulses should be directed to the sides of fluidic oscillator insert 300. For example, a fluidic oscillator device such as the apparatus for creating fluid pulses 100 of the present invention may be used to clean the interior walls of a fluid flowline or a well bore. If this embodiment of the present invention is inserted into an well bore, the pulsating fluid jets will spray directly from the sides of the apparatus onto the interior walls of the well bore, cleaning their surfaces of collected debris and scale. In an exemplary embodiment, the exit flowlines are entirely substantially perpendicular to the flow of fluid into the inlet and are shorter in length than the feedback passages. These short exit flowlines that are entirely substantially perpendicular to the flow of fluid into the inlet may be useful for cleaning well bores and fluid flowlines.

In another exemplary embodiment shown in the top half of FIG. 3, exit flowline 201 is parallel to the flow of fluid into the inlet. In this embodiment, exit port 202 is disposed past downstream end 306 of chamber 303. Again, the benefits of this embodiment to certain applications will be apparent to a person of ordinary skill in the art having the benefit of this disclosure. For example, if the apparatus of the present invention is moved in a direction downstream of the fluid flow, such as left to right in FIG. 3, the exiting pulses precede the advance of the apparatus. This exemplary embodiment may be attached to a down-hole-drilling mechanism such that the fluid jets lubricate and clean the drill bits by ejecting pulses of drilling fluid ahead of the drilling mechanism. The attachment of this exemplary embodiment to a drilling mechanism may be particularly useful when the material to be drilled often clogs the drilling mechanism, such as clay. However, the apparatus of the present invention need not be limited to cleaning purposes but instead may be used in any application requiring pulsating fluid flow.

Figure 4:
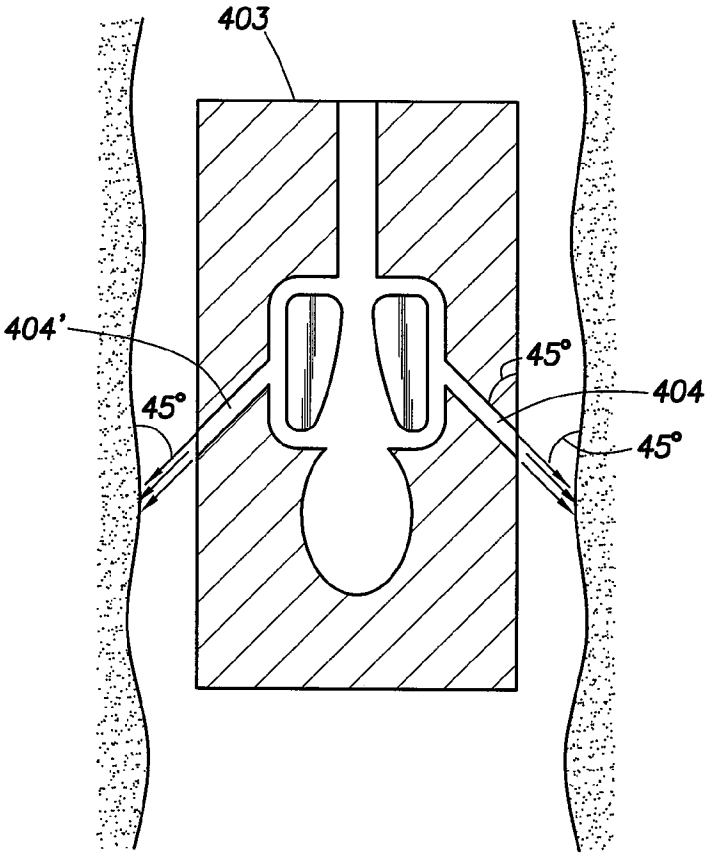
FIG. 4 illustrates an exemplary embodiment of the apparatus of the present invention cleaning a well bore.

In an exemplary embodiment, the exit flowlines are positioned at an angle to the flow of fluid into the inlet. This angle may be calibrated to achieve the goals of a particular application. For example, an operator using the present invention to clean a fluid flowline may find that a jet that hits the interior surface of the fluid flowline obliquely cleans better than a jet that hits the interior surface at a right angle. The optimal angle between the jet and the fluid flowline will depend on the material that needs to be removed from the interior surface of the fluid flowline. The optimal angle for removing softer material will generally be shallower than the optimal angle for removing harder materials. For example, the material in the fluid flowline may have a structure that requires a jet of fluid hitting it at a 45-degree angle in order for it to be removed. If the exit flowline is properly aligned, the fluid will hit the interior surface of the fluid flowline to be cleaned at a 45-degree angle. The angle chosen is not limited to 45 degrees but instead may be any angle best suited to the task for which the apparatus will be used. The erosion rate for a given material, $\epsilon$, depends on the jet angle $\alpha$ according to the following equation: $\epsilon = A \sin^{\beta}\alpha(\cos\alpha - \mu\sin\alpha)$, when $\beta$ is a material property, $\mu$ is the coefficient of friction for the material, and A is a factor that does not depend on the angle. The optimal erosion rate will depend on the relationship between the material parameters captured $\beta$ and $\mu$. Fluid pulses at angle of about 15 degrees to about 30 degrees best erode natural rubber, fluid pulses at an angle of about 20 degrees to about 40 degrees best erode styrene-butadiene, fluid pulses at an angle of about 30 degrees to about 45 degrees best erode carbon steel, and fluid pulses of about 90 degrees will best erode ceramics. FIG. 4 shows an exemplary apparatus for creating pulsating fluid flow 403 with angled exit flowlines 404 and 404' cleaning debris from a well bore.

Figure 5:
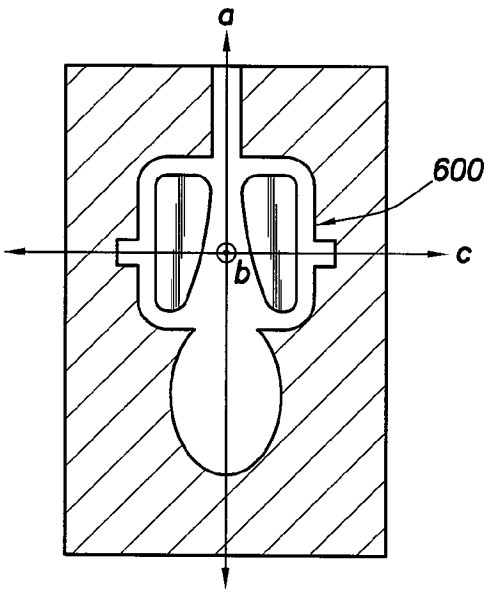
FIG. 5 illustrates a top view of an exemplary embodiment of the apparatus of the present invention.
Figure 6:
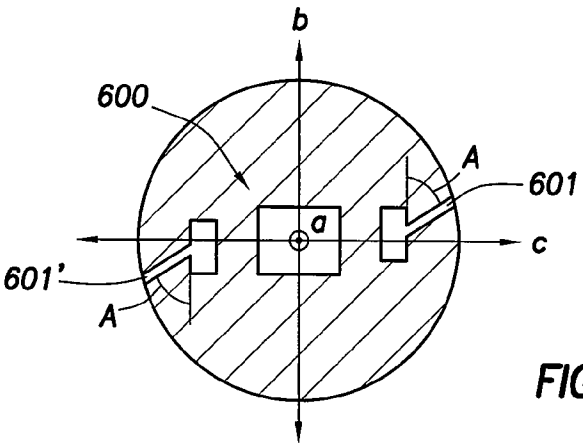
FIG. 6 illustrates a cross-sectional view of the exemplary embodiment shown in FIG. 5.

The angle chosen need not be limited to the plane of the flowpath. FIGS. 5 and 6 depict a certain embodiment in which the exit flowlines diverge from the plane of the flowpath. FIG. 5 shows a top view of a flowpath 600 that includes an axis "b," which ascends out of the plane of the flowpath 600 and is substantially perpendicular to a longitudinal axis "a." FIG. 6 depicts cross section of flowpath 600 taken along a plane created by the axes "b" and "c" shown in FIG. 5. In FIG. 6, axis "a" ascends out of the plane of the page. Exit flowline 601 ascends out of the plane of the page and is at an angle "A" away from a parallel to axis b. Exit flowline 601' descends into the plane of the page and is at an angle A away from a parallel to axis b. This configuration may be particularly beneficial for cleaning settled debris from horizontal flowlines or well bores, a task that is particularly difficult to accomplish with prior art apparatuses. The fluid pulses will create a swirling effect in the horizontal flowline or well bore, sweeping up any settled debris. The swirling motion of the fluid pulses will help keep the debris suspended so that it may be flushed from the horizontal flowline or well bore.

In certain exemplary embodiments, a fluid outlet 313 extends from feedback cavity 310, as shown in the top half of FIG. 3. In an exemplary embodiment, fluid outlet 313 has a much smaller cross-section than feedback passages 307 and 307'. Fluid outlet 313 may be useful for the cleaning applications discussed previously in this disclosure. For example, if the apparatus for creating pulsating fluid flow 100 travels from left to right in FIG. 3 within a fluid flowline, fluid outlet 313 will eject fluid ahead of the apparatus for creating pulsating fluid flow 100. If exit ports 202 and 202' are located alongside feedback passages 307 and 307', apparatus for creating pulsating fluid flow 100 will eject fluid in three directions, allowing it to clean in three directions. However, the apparatus of the present invention may be used in any application requiring pulsating fluid flow.

In certain embodiments of the present invention, the apparatus for creating pulsating fluid flow may be constructed using the following method. A fluidic oscillator insert, such as the fluidic oscillator insert 100 shown in FIG. 2, is created from a mandrel of solid material. The mandrel may be created using any suitable method known to persons of ordinary skill in the art, including, but not limited to, using a lathe to shape a bar of material into the mandrel. The best choices for material and dimensions for the mandrel depend on the application and will be known to persons ordinarily skilled in the art having the benefit of this disclosure. For example, if the apparatus for creating pulsating fluid flow will be used in downhole applications for cleaning well bores, the material used must be capable of withstanding the pressure and chemical makeup of the cleaning fluid, as well as the environmental conditions inside the well bore. In certain exemplary embodiments used in well bores, stainless steel may be used as the material for the mandrel. For downhole applications, the mandrel must be properly sized such that it can attach to the cleaning fluid flowline and placed inside the well bore. Again, the proper dimensions for the mandrel will be readily apparent to persons ordinarily skilled in the art having the benefit of this disclosure.

In an exemplary embodiment of the manufacturing method, a flowpath such as flowpath 301 shown in FIG. 3 must be created in the mandrel. The flowpath may be formed from recesses cut from the mandrel. The recesses may be oriented approximately along a plane in the mandrel or may be oriented in three dimensions in the mandrel, as in FIGS. 5 and 6. Suitable dimensions of the recesses, including the depth, will depend on the application for which the apparatus is intended and will readily apparent to a person ordinarily skilled in the art having the benefit of this disclosure. For certain exemplary embodiments, the recesses may be machined into the surface of the mandrel using a mill. Milling is particularly useful for hard materials such as stainless steel. However, in other exemplary embodiments using softer materials, recesses that form the flowpath may be created using other methods, such as chemical etching. The best size and method for creating the flowpath will again depend on the application and the chosen material, as will be readily apparent to a person ordinarily skilled in the art having the benefit of this disclosure.

In certain exemplary embodiments, multiple flowpaths may be created in the fluidic oscillator insert. For example, in an exemplary embodiment, two opposed flowpaths are created in a single fluidic oscillator insert. These two opposed flowpaths may share the same flowline. On the other hand, in certain embodiments, portions of the two flowpaths may be shared, such as the exit flowlines. The two opposed flowpaths be similarly configured or alternatively, exhibit different configurations. In an exemplary embodiment, the exit ports of one flowpath may be located alongside the feedback passages of that flowpath as shown in the bottom half of FIG. 3, while the exit ports of an opposed flowpath may be located past the feedback chamber of that opposed flowpath, as shown in the top half of FIG. 3. This embodiment ejects pulses of fluid in different directions, allowing for more area coverage by the fluid pulses. This embodiment may be particularly useful for cleaning applications, such as cleaning fluid flowlines or well bores. An operator may connect this exemplary embodiment to a fluid flowline filled with cleaning fluid and then insert it into a larger fluid flowline or well bore, with the apparatus for creating fluid pulses traveling ahead of the fluid flowline filled with cleaning fluid. The pulses emitted from alongside the feedback passages would clean the sides of the flowline or well bore, while the pulses ejected from past the feedback cavity would clean the area of the flowline directly in front of the apparatus. This exemplary embodiment may also be attached to a drilling mechanism such that the fluid jets both lubricate and clean the drill bits by ejecting pulses of drilling fluid ahead of the drilling mechanism and clean the drilled area by ejecting pulses of drilling fluid alongside the drilling mechanism. The attachment of this exemplary embodiment to a drilling mechanism may be particularly useful when the material to be drilled clogs the drilling mechanism, such as clay.

In exemplary embodiments of the present invention, the fluidic oscillator insert created from the mandrel must be enclosed by a housing such as housing 200 shown in FIG. 2. This housing must accommodate the fluidic oscillator insert such that the tops of the recesses in the surface of the fluidic oscillator insert are completely sealed. Sealing the tops of the recesses ensures that the fluid is confined to the flowpath. In certain embodiments, the housing, such as housing 200 shown in FIG. 2, will be created as a hollow cylinder such that the inner surface of the housing fits directly over the surface of the fluidic oscillator insert. In certain embodiments, housing 200 has a opening 215 located such that when the fluidic oscillator insert is inside housing 200, opening 215 is over the chamber. The opening 215 is located over the "x" shown in FIG. 3 for fluidic oscillator insert 100. In certain embodiments, opening 215 has a cross-section on the same order as the cross-section of the flowpath. Opening 215 enhances the pulsing action when the apparatus for creative fluid flow is used in submerged environments.

The housing may be joined to the fluidic oscillator insert using methods readily apparent to persons ordinarily skilled in the art having the benefit of this disclosure. In certain exemplary embodiments, the fluidic oscillator insert may be press fit into the housing such that friction holds the fluidic oscillator insert and the housing together. In other exemplary embodiments, the fluidic oscillator insert may be welded, cemented or joined with one or more threaded members to the housing. In addition, in certain exemplary embodiments, the fluid flowline 400 connects to housing 200, fluidic oscillator insert 300 or both, as shown generally in FIG. 2. In an exemplary embodiment, housing 200 fits over the end of flowline 400, as shown in FIG. 3. The interior of housing 200 may have ridges and grooves that allow a flowline with opposing ridges and grooves to lock into housing 200. The best method for joining housing 200, fluidic oscillator insert 300 or both to fluid flowline 400 will be readily apparent to a person ordinarily skilled in the art having the benefit of this disclosure.

Figure 1:
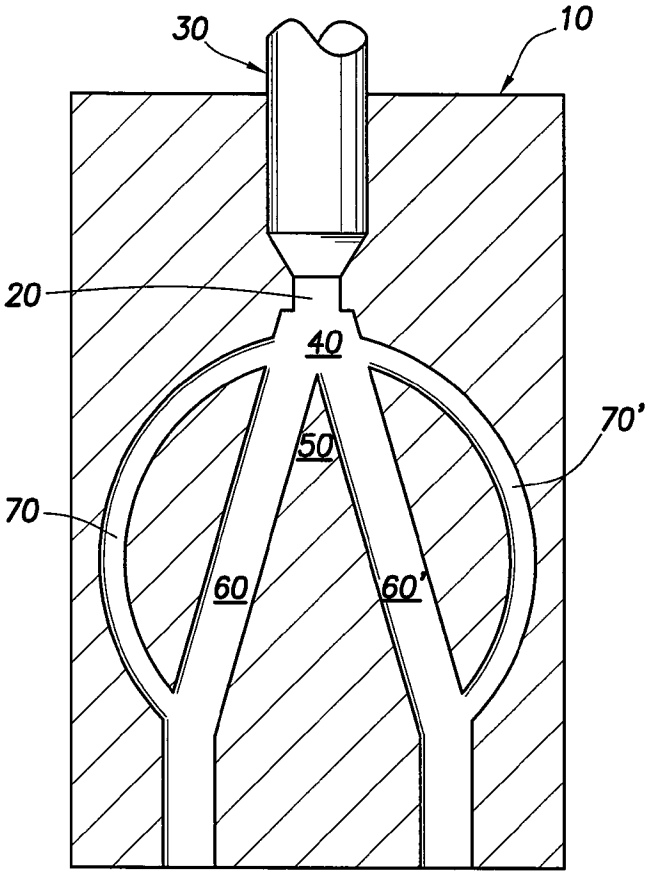
FIG. 1 illustrates a prior art apparatus for creating pulsating fluid flow.
Figure 7:
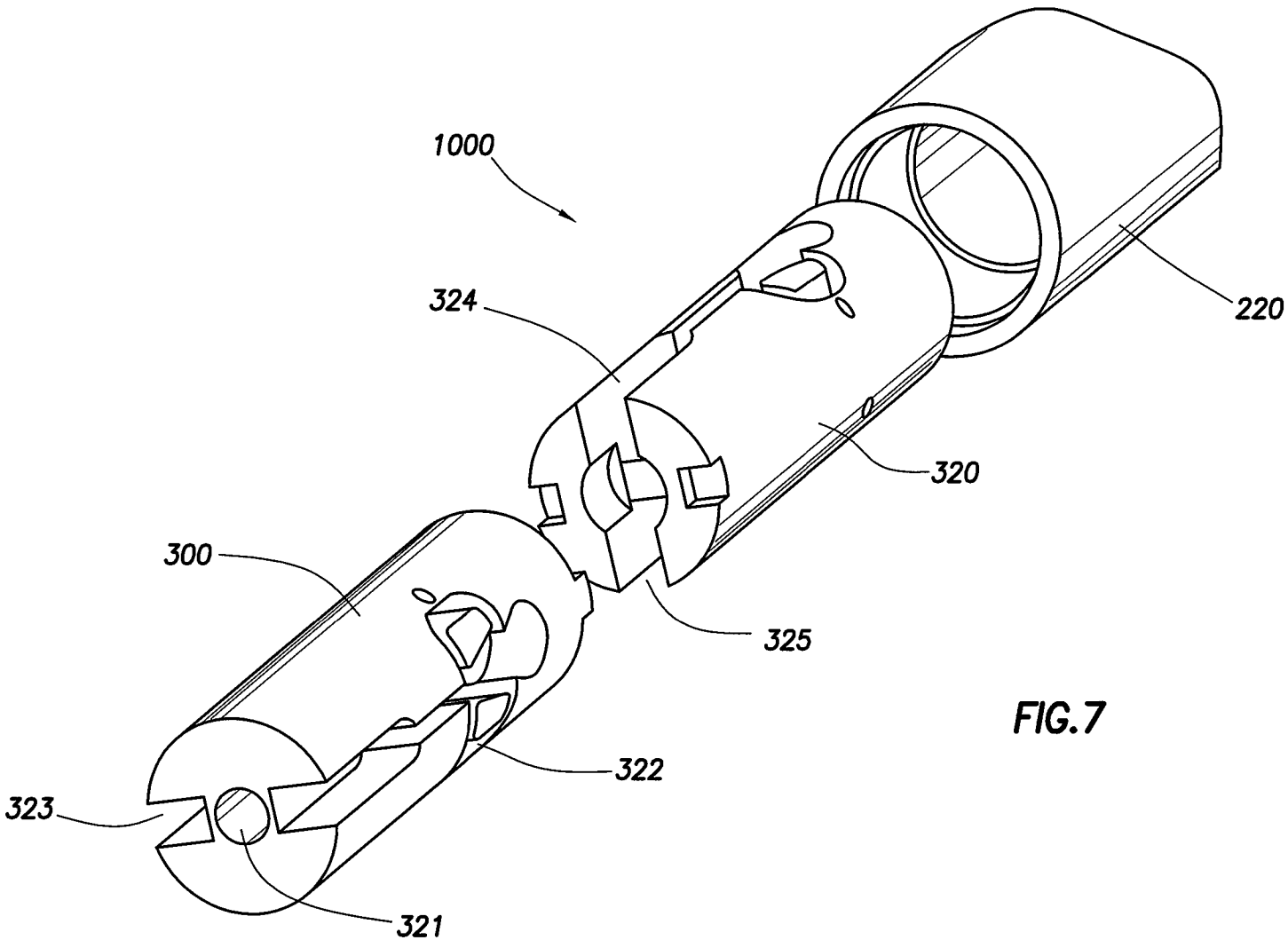
FIG. 7 illustrates an exemplary embodiment of the apparatus of the present invention.

In certain exemplary embodiments, additional fluidic oscillator inserts may be disposed downstream from fluidic oscillator insert 300, as shown in FIG. 7. Housing 220 is much like housing 200, shown in FIG. 1, except that housing 220 is large enough to accommodate a second fluidic oscillator insert 320 as well as fluidic oscillator insert 300. In this embodiment, fluidic oscillator insert 300 will have a passageway 321 to allow fluid to flow from flowline 400 through fluidic oscillator insert 300 into fluidic oscillator insert 320. The particular embodiment of apparatus for creating pulsating fluid flow 1000 shown in FIG. 7 has four flowpaths, 322, 323, 324 and 325. Two opposing flowpaths 322 and 323 are disposed in fluidic oscillator insert 300 and two opposing flowpaths, 324 and 325, are disposed in second fluidic oscillator insert 320. As a person of ordinary skill in the art having the benefit of this disclosure will realize, multiple configurations for the flowpaths are possible.

In an alternative exemplary embodiment, the flowpath may be created in a half mandrel having a flat surface along a longitudinal axis of the half mandrel. FIG. 8 displays an exemplary apparatus for creating pulsating fluid flow 700 created in a half mandrel 703. Flowpath 701 is formed of recesses in a flat plane 702 located on half mandrel 703. Flowpath 701 is covered by half mandrel 704 such that no fluid can escape from the recesses during operation. Half mandrel 703 may be joined to half mandrel 704 along flat plane 702 using methods readily apparent to persons of ordinary skill in the art having the benefit of this disclosure. For example, half mandrel 703 may be welded, cemented or joined with one or more threaded members to half mandrel 704. Any of the flowpaths of the present invention may be formed in this embodiment. A housing may be unnecessary for this exemplary embodiment. If a housing is not used, the entire flowpath 701 must be contained within half mandrels 703 and 704, and exit ports for the pulsating fluid flow, as described earlier in this disclosure, must be located on the rounded surface of the half mandrels.

Figure 9:
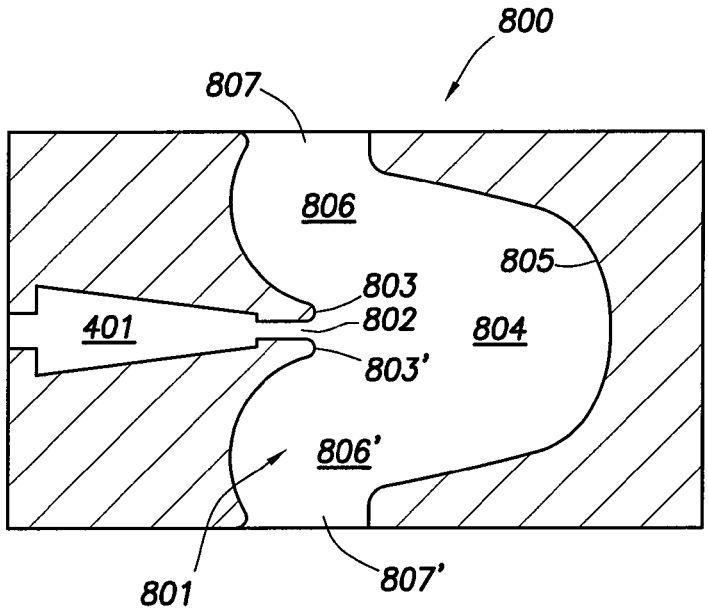
FIG. 9 illustrates a top view of an exemplary embodiment of the apparatus of the present invention.

FIG. 9 depicts a top view of another exemplary embodiment of fluidic oscillator insert 800 with a flowpath 801. Flowpath 801 may be created in a mandrel to produce a fluidic oscillator insert that fits in a housing or in two half mandrels that do not require a housing using methods described earlier in this disclosure. As with FIG. 3, FIG. 9 depicts flowpath 801 in two dimensions for simplicity. Flowpath 801, however, is formed of recesses in fluidic oscillator insert 800. Flowpath 801 therefore has a depth that descends into the plane of the page in FIG. 9. Fluid enters fluidic oscillator insert 800 through a fluid flowline into interior flowline 401. As shown in FIG. 9, interior flowline 401 need not maintain a constant width over its length.

Interior flowline 401 directs the fluid through inlet 802. Inlet 802 is disposed between two opposed cusps 803 and 803' that protrude into an oscillation cavity 804. Inlet 802 ejects the fluid as a jet into oscillation cavity 804. Oscillation cavity 804 is defined by a concave rear wall 805. Two opposed exit flowlines 806 and 806' leave the oscillation cavity 804 near inlet 802 and cusps 803 and 803'. These two opposed exit flowlines 806 and 806' curve such that a portion of the opposed exit flowlines 806 and 806' is substantially perpendicular to the flow of fluid into inlet 802. Each of the two opposed exit flowlines 806 and 806' has an exit port 807 and 807', respectively.

Upon leaving inlet 802, the jet passes through oscillation cavity 804 to concave rear wall 805. At concave rear wall 805, the jet divides into two flows of fluid. A first flow of fluid will travel along concave rear wall 805 to the top half of the oscillation cavity 804 as it is depicted in FIG. 9. Because this flow will follow the curve of concave rear wall 805, it will begin to rotate counterclockwise. A second flow will travel along concave wall 805 to the bottom half of the oscillation cavity 804 as it is depicted in FIG. 9. This flow will begin to rotate clockwise because it will follow the curve of concave rear wall 805 in a direction opposite the first flow. The two opposed exit flowlines 806 and 806' will emit fluid through exit ports 807 and 807', respectively. The exit ports 807 and 807' will eject the fluid substantially perpendicular to the flow of fluid into inlet 802.

While these two flows will initially be symmetrical, their motion is inherently unstable. Inevitably, a small aberration in the fluid flow or apparatus will disturb the fluid flow such that the jet is pushed slightly to one side of oscillation cavity 804. This disturbance will cause the rotating flows to become asymmetrical. The rotating flows will force the jet to oscillate from the top of the oscillation cavity 804 to the bottom of oscillation cavity 804 as it is depicted in FIG. 9. When the jet is at the top of oscillation cavity 804, it will feed fluid into the clockwise flow, which will grow larger and send fluid into opposed exit flowline 806'. As a result, exit port 807' will emit fluid. However, the counterclockwise flow will be small and no fluid will enter opposed exit flowline 806. Thus no fluid will pass through exit port 807. As it oscillates, the jet will be drawn to the bottom of oscillation cavity 804, feeding fluid into the counterclockwise flow. The counterclockwise flow will then grow larger and dominate the clockwise flow, cutting off the fluid supply to opposed exit flowline 806'. Fluid will then enter opposed exit flowline 806. At this point, exit port 807 will emit fluid, but exit port 807' will not. This cycle will repeat, resulting in pulsating fluid flow through exit ports 807 and 807' in succession. Because a portion of opposed exit flowlines 806 and 806' is substantially perpendicular to the flow of fluid into inlet 802, the pulsating fluid flow through exit ports 807 and 807' creates a fan-shaped jet that covers a broad angle range. Accordingly, fluidic oscillator insert 800 may be used to clean a broader surface area than a fluidic oscillator insert having opposed exit flowlines at a different angle.

Figure 10:
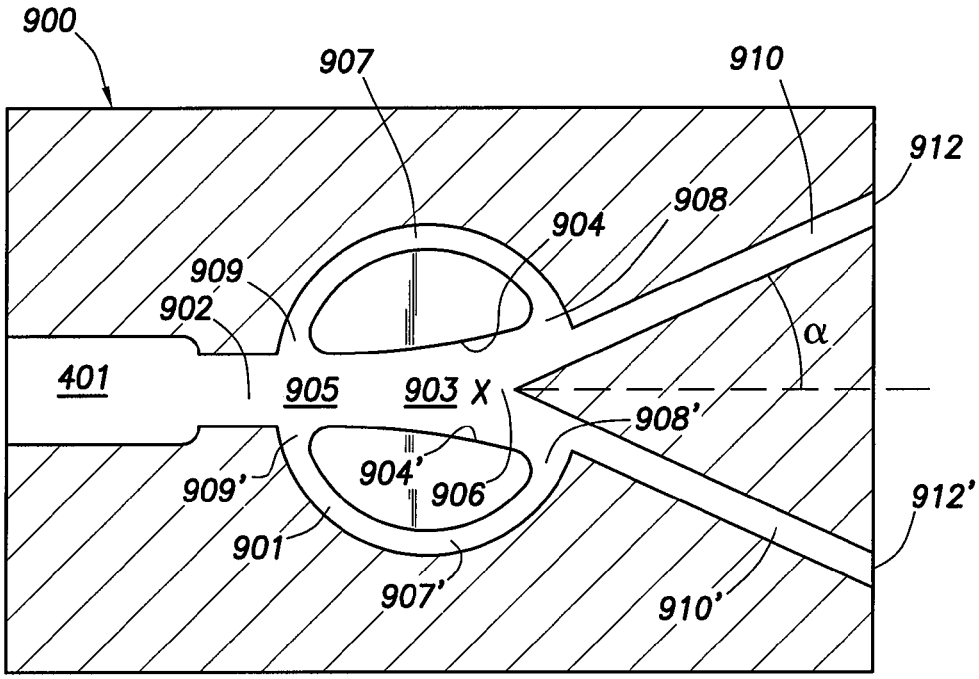
FIG. 10 illustrates a top view of an exemplary embodiment of the apparatus of the present invention.

FIG. 10 depicts a top view of another exemplary embodiment of fluidic oscillator insert 900 with a flowpath 901. Flowpath 901 may be created in a mandrel to produce a fluidic oscillator insert that fits in a housing or in two half mandrels that do not require a housing using the methods described earlier in this disclosure. As with FIG. 3, FIG. 10 depicts flowpath 901 in two dimensions for simplicity. Flowpath 901, however, is formed of recesses in fluidic oscillator insert 900. Flowpath 901 therefore has a depth that descends into the plane of the page in FIG. 10. Fluid enters fluidic oscillator insert 900 through fluid flowline 400 into interior flowline 401. As shown in FIG. 10, interior flowline 401 need not maintain a constant width over its length. Interior flowline 401 directs the fluid through inlet 902. Inlet 902 ejects the fluid as a jet into chamber 903. Chamber 903 is defined by two outwardly-projecting sidewalls 904 and 904' and has an upstream end 905 and a downstream end 906. Two exit flowlines 910 and 910' leave from the downstream end 906 of chamber 903. Exit flowlines 910 and 910' diverge such that they are disposed at an angle $\alpha$ from the flow of fluid into inlet 902. Each exit flowline 910 or 910' terminates in an exit port 912 or 912', respectively.

The fluid will oscillate in fluidic oscillator insert 900 in much the same manner as the fluid oscillates in fluidic oscillator insert 300, illustrated in FIG. 3. The fluid will initially cling to one of the two outwardly-projecting sidewalls 904 or 904'. As it reaches the end of either outwardly-projecting sidewall 904 or 904', a portion of the fluid will enter one of at least two feedback passages 907 and 907', respectively. Feedback passages 907 and 907' are disposed on opposite sides of chamber 903. Opposed entrances 908 and 908' to the feedback passages 907 and 907' leave from the downstream end 906 of chamber 903. Opposed exits 909 and 909' to the feedback passages 907 and 907' join the upstream end 905 of chamber 903. If a portion of the fluid travels along outwardly-projecting sidewall 904 initially, it will enter feedback passage 907 through opposed entrance 908. Feedback passage 907 will direct that fluid back into chamber 903 through opposed exit 909. As with the fluidic oscillator insert shown in FIG. 3, the fluid leaving feedback passage 907 will disturb the flow of fluid along outwardly-projecting sidewall 904. The flow will then switch to traveling along outwardly-projecting sidewall 904', and the process will repeat.

While a portion of the fluid is diverted through the feedback passages 907 and 907', the rest of the fluid will enter exit flowline 910 and 910', respectively. For example, part of the fluid traveling along outwardly-projecting sidewall 904 will be partially diverted into feedback passage 907. The rest of the fluid will travel through exit flowline 910 and exit the fluidic oscillator insert 900 through exit port 912. Fluid traveling along outwardly-projecting sidewall 904' will be partially diverted into feedback passage 907'. The rest of the fluid will travel through exit flowline 910' and exit the fluidic oscillator insert 900 through exit port 912'. As the fluid oscillates between outwardly-projecting sidewalls 904 and 904', exit ports 912 and 912' will emit fluid pulses in succession.

Because fluid flowlines 910 and 910' diverge, fluidic oscillator insert 900 discharges fluid at an angle from the flow of fluid into the inlet. As a result, fluidic oscillator insert 900 can be used in applications requiring pulses that precede the apparatus but are located to the sides of the apparatus. To cite just one example, these pulses may be useful in cleaning fluid flowlines or well bores. As discussed earlier in the disclosure, the exit angle can be tailored to maximize the clearing rate for a particular fluid flowline. In certain embodiments, the angle $\alpha$ from the flow of fluid into the inlet will be in the range of approximately 10 degrees to approximately 60 degrees. In certain embodiments, the angle from the flow of fluid into the inlet will be in the range of approximately 20 degrees to approximately 45 degrees. Further, the "x" shown in FIG. 10 indicates the location of an opening 215 in housing 200, shown in FIG. 2. In certain embodiments, the cross-section of this opening will be on the order of the cross-section of the flowpath. Again, this opening enhances the pulsing action of the apparatus for creating pulsating fluid flow when it is used in submerged environments.

Therefore, the present invention is well-adapted to carry out the objects and attain the ends and advantages mentioned, as well as those that are inherent therein. While the invention has been depicted, described, and is defined by reference to the exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only and are not exhaustive of the invention. Consequently, the invention is intended to be limited only by the spirit and scope of the appended claims, giving full cognizance to equivalents in all respects.

What is claimed is:

1. An apparatus for creating a pulsating fluid flow, comprising:

an inlet into which fluid flows, a chamber having an upstream end and a downstream end, wherein the chamber is defined by a pair of outwardly-projecting sidewalls and wherein the inlet is disposed at the upstream end of the chamber, at least two feedback passages having opposed entrances at the downstream end of the chamber and opposed exits at the upstream end of the chamber near where the chamber joins the inlet, a feedback cavity disposed at the downstream end of the chamber, and at least one exit flowline leaving each of the feedback passages, wherein the at least one exit flowline has an exit port;

wherein a pulsating fluid flow is generated through the exit port; and wherein the inlet, the chamber, the at least two feedback passages, the feedback cavity and the at least one exit flowline leaving each of the two feedback passages are disposed on a half mandrel.

2. The apparatus of claim 1, wherein the entirety of the at least one exit flowline is substantially perpendicular to the flow of fluid into the inlet.

3. The apparatus of claim 1, wherein a portion of the at least one exit flowline is parallel to the flow of fluid into the inlet.

4. The apparatus of claim 1, wherein the exit port of the at least one exit flowline is disposed near the upstream end of the chamber.

5. The apparatus of claim 1, wherein the exit port of the at least one exit flowline is disposed near the downstream end of the chamber.

6. The apparatus of claim 1, wherein the exit ports of the at least one exit flowlines are disposed near the upstream end of the chamber at an angle to a plane containing the chamber.

7. The apparatus of claim 1, wherein the exit ports of the at least one exit flowlines are disposed near the downstream end of the chamber at an angle to a plane containing the chamber.

8. The apparatus of claim 1, wherein the exit port of one at least one exit flowline leaving one of the at least two feedback passages is disposed at an angle behind the plane containing the chamber.

9. The apparatus of claim 1, wherein the exit port of one at least one exit flowline leaving one of the at least two feedback passages is disposed at an angle in front of the plane containing the chamber.

10. The apparatus of claim 9 wherein the exit port of another at least one exit flowline leaving one of the at least two feedback passages is disposed at an angle behind the plane containing the chamber.

11. The apparatus of claim 1, further comprising at least one fluid outlet leaving the feedback cavity.

12. The apparatus of claim 11, wherein the at least one fluid outlet is parallel to the flow of fluid into the inlet.

13. The apparatus of claim 1, further comprising:

a second inlet from the fluid flowline, a second chamber having an upstream end and a downstream end, wherein the second chamber is defined by a second pair of outwardly-projecting sidewalls and wherein the second inlet is disposed at the upstream end of the second chamber, at least two second feedback passages having opposed entrances at the downstream end of the second chamber and opposed exits at the upstream end of the second chamber near where the second chamber joins the second inlet, a second feedback cavity disposed at the downstream end of the second chamber, and at least one second exit flowline leaving each of the second feedback passages, wherein the at least one second exit flowline has an exit port.

14. The apparatus of claim 13, wherein the second inlet, the second chamber, the at least two second feedback passages, the second feedback cavity, and the at least one second exit flowline are disposed beneath the chamber.

15. The apparatus of claim 1, further comprising:

a second inlet into which fluid flows, a second chamber having an upstream end and a downstream end, wherein the second chamber is defined by a second pair of outwardly-projecting sidewalls and wherein the second inlet is disposed at the upstream end of the second chamber, at least two second feedback passages having opposed entrances at the downstream end of the second chamber and opposed exits at the upstream end of the second chamber near where the second chamber joins the second inlet, a second feedback cavity disposed at the downstream end of the second chamber, and at least one second exit flowline leaving each of the second feedback passages, wherein the at least one second exit flowline has an exit port.

16. The apparatus of claim 15, wherein the second inlet, second chamber, the at least two second feedback passages, the second feedback cavity, and the at least one second exit flowline are disposed beneath the chamber on the half mandrel.

17. The apparatus of claim 1, wherein a portion of the at least one exit flowline is substantially perpendicular to the flow of fluid into the inlet.

18. The apparatus of claim 17, wherein another portion of the at least one exit flowline is parallel to the flow of fluid into the inlet.

19. The apparatus of claim 18, wherein the exit port of the at least one exit flowline is disposed near the upstream end of the chamber.

20. The apparatus of claim 18, wherein the exit port of the at least one exit flowline is disposed near the downstream end of the chamber.

21. The apparatus of claim 1, wherein the at least one exit flowline is disposed at an angle to the flow of fluid into the inlet.

22. The apparatus of claim 21, wherein the angle at which the at least one exit flowline is disposed is determined by the application for which the apparatus for creating pulsating fluid flow will be used.

23. The apparatus of claim 21, wherein the angle at which the at least one exit flowline is disposed is between 10 degrees and 60 degrees.

24. The apparatus of claim 21, wherein the angle at which the at least one exit flowline is disposed is between 20 degrees and 45 degrees.

25. An apparatus for creating a pulsating fluid flow, comprising:

an inlet into which fluid flows, a chamber having an upstream end and a downstream end, wherein the chamber is defined by a pair of outwardly-projecting sidewalls and wherein the inlet is disposed at the upstream end of the chamber, at least two feedback passages having opposed entrances at the downstream end of the chamber and opposed exits at the upstream end of the chamber near where the chamber joins the inlet, at least one feedback outlet leaving each of the feedback passages, a feedback cavity disposed at the downstream end of the chamber, and at least one exit flowline leaving the at least one feedback outlet, wherein the at least one exit flowline has an exit port;

wherein a pulsating fluid flow is generated through the exit port; and wherein the inlet, the chamber, the at least two feedback passages, the at least one feedback outlet, and the feedback cavity are disposed on a mandrel to form a first fluidic oscillator insert.

26. The apparatus of claim 25, wherein the at least one feedback outlet is substantially perpendicular to a tangent to the feedback passage on which it is disposed, wherein the tangent is taken at the point where the at least one feedback outlet is located.

27. The apparatus of claim 25 wherein the entirety of the at least one exit flowline is substantially perpendicular to the flow of fluid into the inlet.

28. The apparatus of claim 25 wherein a portion of the at least one exit flowline is parallel to the flow of fluid into the inlet.

29. The apparatus of claim 25 wherein the exit port of the at least one exit flowline is disposed near the upstream end of the chamber.

30. The apparatus of claim 25 wherein the exit port of the at least one exit flowline is disposed near the downstream end of the chamber.

31. The apparatus of claim 25 wherein the exit port of the at least one exit flowline is disposed near the upstream end of the chamber at an angle to a plane containing the chamber.

32. The apparatus of claim 25 wherein the exit port of the at least one exit flowline is disposed near the downstream end of the chamber at an angle to a plane containing the chamber.

33. The apparatus of claim 25 wherein the exit port of one at least one exit flowline leaving one of the at least two feedback passages is disposed at an angle behind the plane containing the chamber.

34. The apparatus of claim 25 further comprising a housing that accommodates the fluidic oscillator insert.

35. The apparatus of claim 25, wherein the at least one exit flowline is formed in the housing.

36. The apparatus of claim 25, wherein the housing comprises an opening over the chamber.

37. The apparatus of claim 25, wherein the at least one exit flowline is disposed at an angle to the flow of fluid into the inlet.

38. The apparatus of claim 37 wherein the angle at which the at least one exit flowline is disposed is determined by the application for which the apparatus for creating pulsating fluid flow will be used.

39. The apparatus of claim 25 wherein the exit port of one at least one exit flowline leaving one of the at least two feedback passages is disposed at an angle in front of the plane containing the chamber.

40. The apparatus of claim 39 wherein the exit port of another at least one exit flowline leaving one of the at least two feedback passages is disposed at an angle behind the plane containing the chamber.

41. The apparatus of claim 25, further comprising at least one fluid outlet leaving the feedback cavity.

42. The apparatus of claim 41, wherein the at least one fluid outlet is parallel to the flow of fluid into the inlet.

43. The apparatus of claim 25 wherein a portion of the at least one exit flowline is substantially perpendicular to the flow of fluid into the inlet.

44. The apparatus of claim 43 wherein another portion of the at least one exit flowline is parallel to the flow of fluid into the inlet.

45. The apparatus of claim 44, wherein the exit port of the at least one exit flowline is disposed near the upstream end of the chamber.

46. The apparatus of claim 44, wherein the exit port of the at least one exit flowline is disposed near the downstream end of the chamber.

47. The apparatus of claim 25, further comprising:

a second inlet into which fluid flows, a second chamber having an upstream end and a downstream end, wherein the second chamber is defined by a second pair of outwardly-projecting sidewalls and wherein the second inlet is disposed at the upstream end of the second chamber, at least two second feedback passages having opposed entrances at the downstream end of the second chamber and opposed exits at the upstream end of the second chamber near where the second chamber joins the second inlet, at least one second feedback outlet leaving each of the second feedback passages, a second feedback cavity disposed at the downstream end of the second chamber, and at least one second exit flowline leaving the at least one second feedback outlet, wherein the at least one exit flowline has an exit port.

48. The apparatus of claim 47, further comprising a housing that accommodates the fluidic oscillator insert.

49. The apparatus of claim 48, wherein the at least one exit flowline and at least one second exit flowline are formed in the housing.

50. The apparatus of claim 48, wherein the second inlet, the second chamber, the at least two second feedback passages, the at least one second feedback outlet, and the second feedback cavity are disposed beneath the chamber on the fluidic oscillator insert.

51. The apparatus of claim 48, wherein the second inlet, the second chamber, the at least two second feedback passages, the at least one second feedback outlet, and the second feedback cavity are disposed on a second mandrel to create a second fluidic oscillator insert.

52. The apparatus of claim 30, wherein the second fluidic oscillator insert is disposed downstream from the fluidic oscillator insert.

53. The apparatus of claim 51, wherein the housing accommodates the fluidic oscillator insert and the second fluidic oscillator insert.

54. The apparatus of claim 53, further comprising a passageway through which fluid may flow through the fluidic oscillator insert into the second fluidic oscillator insert.

* * * * *